United States Patent [19]

Mukainakano et al.

[11] Patent Number: 4,523,552

[45] Date of Patent: Jun. 18, 1985

[54] IGNITION SYSTEM FOR ENGINE

[75] Inventors: Shinichi Mukainakano; Tadashi Hattori; Minoru Nishida, all of Okazaki; Toru Mizuno, Aichi; Tukasa Goto, Toyota, all of Japan

[73] Assignees: Nippondenso Co., Ltd., Kariya; Nippon Soken, Inc., Nishio, both of Japan

[21] Appl. No.: 489,382

[22] Filed: Apr. 28, 1983

[30] Foreign Application Priority Data

Apr. 29, 1982 [JP] Japan ..... 57-71732

[51] Int. Cl.[3] ..... F02P 23/04

[52] U.S. Cl. ..... 123/143 B; 123/23; 123/143 R; 123/305

[58] Field of Search ..... 123/143 B, 143 R, 23, 123/298, 24 R, 304, 305

[56] References Cited

U.S. PATENT DOCUMENTS 3,861,371 1/1975 Gamell ..... 123/143 B
4,314,530 2/1982 Giacchetti ..... 123/143 B
4,434,753 3/1984 Mukainakano et al. ..... 123/143 B

FOREIGN PATENT DOCUMENTS 55-87861 7/1980 Japan ..... 123/143 B

*Primary Examiner*—Andrew M. Dolinar
*Attorney, Agent, or Firm*—Cushman, Darby & Cushman

[57] ABSTRACT

An ignition device for use with internal combustion engines is adapted for conducting a light beam into the combustion chamber of the engine to ignite a fuel-air mixture. The ignition device includes a light emission apparatus opened to the combustion chamber to emit a light beam into the chamber, and a particle supply apparatus disposed in opposed relation with the light emission apparatus for supplying into the combustion chamber particles of a high light absorption index separately from the fuel-air mixture. The particles from the particle supply apparatus are emitted along the optical axis of the light beam into the combustion chamber and are heated at a position suitable for ignition of the fuel-air mixture within the combustion chamber to serve as an ignition source.

8 Claims, 5 Drawing Figures

IGNITION SYSTEM FOR ENGINE

BACKGROUND OF THE INVENTION

This invention relates to an ignition device for internal combustion engines, and more particularly to an ignition device for igniting the fuel-air mixture by means of the light-beam.

The fuel-air mixture has been conventionally ignited by means of sparking devices, such as a spark plug which is mounted on the wall of an internal combustion engine to produce spark discharge through making use of high-voltage. This type of sparking device has a drawback in that owing to adhesion of carbon to the surface of an insulator and consumption of electrodes in use discharge energy is progressively reduced or electric discharge is difficult to be effected or ignition of the fuel-air mixture.

There has been a problem in connection with the durability of a spark plug which is selectively disposed to extend centrally of the combustion chamber so that electric discharge is produced at a location suitable for ignition in terms of air-fuel ratio in the combustion chamber and flow of the fuel-air mixture.

Ignition devices have been proposed which use a high energy light such as laser beam for igniting the fuel-air mixture. With this type of ignition device, light energy is directly irradiated on the fuel-air mixture. Since the light absorption index of the gases, namely the fuel-air mixture is small, however, it is difficult in this type of ignition device to ignite the fuel-air mixture in a short period of time corresponding to the rotating speed of the engine due to temperature rise attained by the absorption of light energy. Accordingly, ignition of the fuel-air mixture is conventionally attained by dielectric breakdown thereof (plasma state of the mixture) which is caused in the field of high light energy of the order of scores of megawatt. Therefore, it is necessary to provide a light generating device, such as a giant pulsed laser of a large output, which is large in consumption of electric power and is inefficient and large-sized in construction. Thus, this type of ignition device is not practical.

SUMMARY OF THE INVENTION

It is an object of the present invention to provide an ignition device which overcomes the above-mentioned disadvantages of the prior ignition devices.

The objects and purposes of the present invention are met by providing an ignition device which enables efficient ignition of the fuel-air mixture by causing particulates of a high absorption index of light energy to absorb light energy, causing a light beam of a relatively low energy density to hasten temperature rise of the particulates in a short period of time and exploiting heat energy of the particulates or plasma energy produced with the particulates serving as nuclei.

The objects and advantages of the present invention will become apparent from the following description together with the accompanying drawings.

DESCRIPTION OF THE PREFERRED EMBODIMENT

Figure 1:
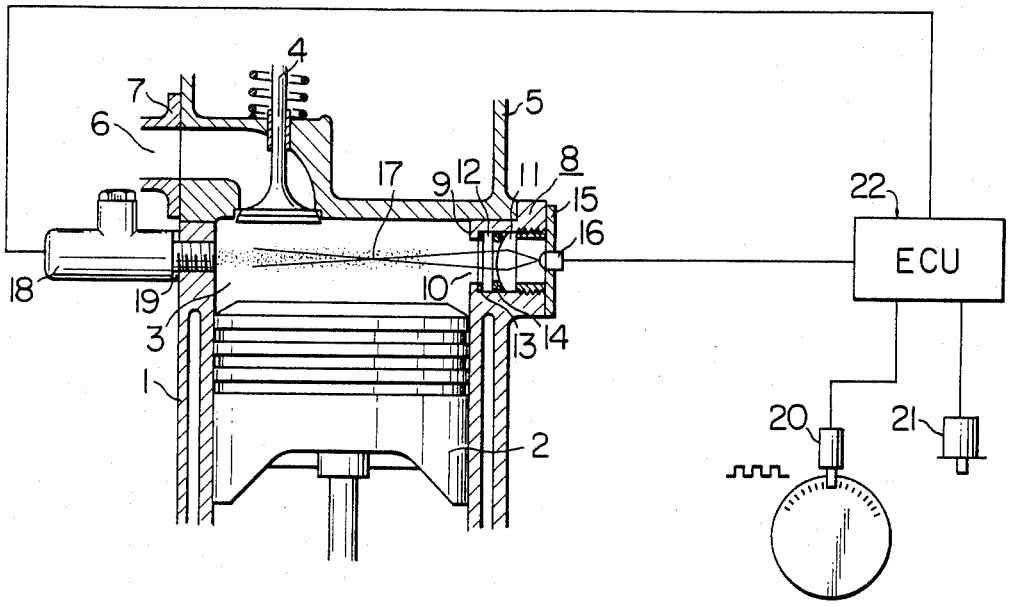
FIG. 1 is a diagrammatic view of an embodiment of the present invention.

Referring now to FIG. 1, there is shown one cylinder of a multi-cylinder type internal combustion engine, in which an ignition device according to the present invention is incorporated. The cylinder includes a cylinder housing 1, a piston 2, a combustion chamber 3, a cylinder head 5, a suction valve 4, an intake manifold 7 and a suction passage 6 defined by the intake manifold 7 and the cylinder head 5. The suction valve 4 is mounted on the cylinder head 5 which defines the upper wall of the combustion chamber 3. A condensing device 8 is provided on the wall 9 of the combustion chamber 3 and comprises a highly heat-resisting, condensing lens 11 mounted in a bore 10 formed in the combustion chamber wall 9, a heat-resisting glass 12 for protection of the condensing lens 11 and a light source 16, such as a laser of a relatively low output, provided centrally of a support 15. The condensing lens 11 and the heat-resisting glass 12 are mounted in the bore 10 of the combustion chamber wall 9 such that a sealing member 13 made of asbestos seals the heat-resisting glass 12 against the bore 10 and a cushion ring 14 interposes between the heat-resisting glass 12 and the lens 11 to permit threaded engagement of the support 15 with the bore 10 of the combustion chamber wall 9 for the pressing of the lens 11 against the glass 12. The condensing device 8 is disposed at an angle relative to the combustion chamber wall 9 so as to result in the light lays generated by the light source 16 being concentrated at a point 17 where ignition of the fuel-air mixture is most ready to occur under the influence of various factors such as an air-fuel ratio of the fuel-air mixture located within the combustion chamber 3 and flow of the fuel-air mixture.

A particle supply device 18 is provided for supplying solid particles toward the light-beam condensing point 17 of the highest light intensity through the light beam along the optical axis thereof, which solid particles may be ones, such as powdered coal, having a high absorption index for light energy and adapted to burn due to the combustion of the fuel-air mixture or non-combustible ones such as black alumite and carborundum. The particle supply device 18 is threadedly jointed to the cylinder housing 1 with a sealing member 19 therebetween to be opened to the combustion chamber 3 such that the solid particles pass through the light-beam condensing point 17 along the optical axis under the influence of various factors such as the spurting speed, gravity and the flow pattern of the fuel-air mixture. A crank angle or rotational speed is detected by a crank angle detector 20 which is directly connected to the crank shaft of an engine (not shown), and a suction pressure is detected by a suction pressure detector 21 which is communicated to the suction passage 6, that is, the interior of the intake manifold 7. There is provided an electric control unit (ECU) 22 for periodically actuating the light source 16 and periodically or continuously actuating the particle supply device 18 at optimum points of time which are determined dependent upon the operating condition of the engine by the detected crank angle and the detected suction pressure.

Figure 2:
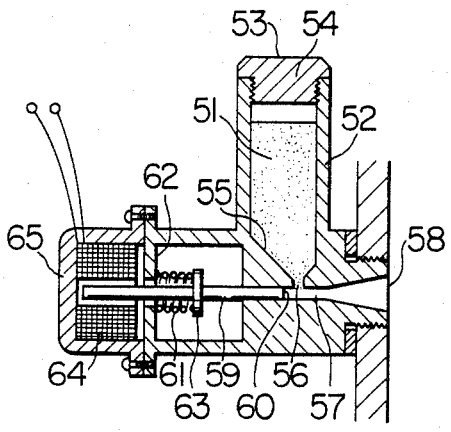
FIG. 2 is a detailed sectional view of a particulate supply device in the embodiment of FIG. 1.

In FIG. 2, there is shown the detail of the particle supply device 18. The device 18 comprises a housing 52, a storage chamber 51 defined by the housing 52 for storing the solid particles, a supply port 53 formed at the top of the storage chamber 51, a cap 54 threadedly fitted into the supply port 53 for closing the storage chamber 51, an injection conduit 57 formed through the housing 52, a rod 59 closely and slidably inserted into the injection conduit 57, a compression spring 61 fitted on the rod 59 between the end wall 62 of the housing 52 and a collar 63 integrally formed on the rod 59 and a solenoid 64 contained in a casing 65 securedly attached to the housing 52. The bottom portion of the housing 52 is tapered and formed at its lowermost area with a communication conduit 56 through which the solid particles are fed to the injection conduit 57 by gravity. The injection conduit 57 is tapered at its one end with an injection port 58 to be opened to the combustion chamber 3 as shown in FIG. 1. The end 60 of the rod 59 on the side of the injection port 58 lies in a plane perpendicular to the length of the rod. The compression spring 61 normally biases the rod 59 toward the injection port 58 and the other end of the rod 59 opposite to the injection port 58 is circumferentially surrounded by the solenoid 64 to be attracted into the interior thereof upon the energization of the solenoid. Conductors 66 extend to the outside through the wall of the casing 65 in a sealing manner as by the use of a hermetic seal.

The ignition device thus constructed operates in the following manner. In a suction stroke with the suction valve 4 of the engine opened, the fuel-air mixture supplied through a carburetter and a fuel injection valve of the engine is sucked into the combustion chamber 3 via the suction passage 6 to reach the light-beam condensing point 17 until a compression stroke is started to close the suction valve 4 and raise the piston 2. Also, the solid particles is injected continuously or at an ignition point of time from the injection port 58 of the particle supply device 18 to reach the light-beam condensing point 17 of the highest light intensity along the optical axis owing to the fact that electric energization of the particle supply device 18 by the electric control unit 22 is cut off at a suitable point of time when the solid particles reaches the point 17.

With reference to FIG. 2, the operation of the particle supply device 18 is set forth in detail hereinbelow. When the particles are not to be supplied to the combustion chamber 3, electric energization from the electric control unit 22 causes the solenoid 64 to attract the rod 59 toward it and bring the end 60 of the rod 59 opposite to the injection port 58 to a position adjacent to the communication conduit 56, through which the storage chamber 51 is communicated to the injection conduit 57, so that the particles contained within the storage chamber 51 pass through the communication conduit 56 to deposited in the injection conduit 57. Upon the cutting-off of electric energization of the solenoid 64 at the required point of time as described above, the rod 59 is forcibly moved toward the injection port 58 due to the biasing force of the compression spring 61 to emit from the injection port 58 the particles having been deposited in the injection conduit 57.

With reference to FIG. 1, the light source 16 generates a light beam upon receipt of an electric signal transmitted from the electric control unit 22 at an optimum ignition point of time determined dependent upon the operating condition of the engine by the crank angle detected at the crank angle detector 20 and the suction pressure detected at the suction pressure detector 21. The particles having reached the light-beam condensing point 17 absorbs energy of the high intensity light to be rapidly heated to be brought to a high temperature condition or a plasma condition, so that owing to the heat energy or plasma energy thus produced the particles serve as an ignition source to ignite the fuel-air mixture, thereby causing propagation of flame and combustion of the mixture.

Figure 3:
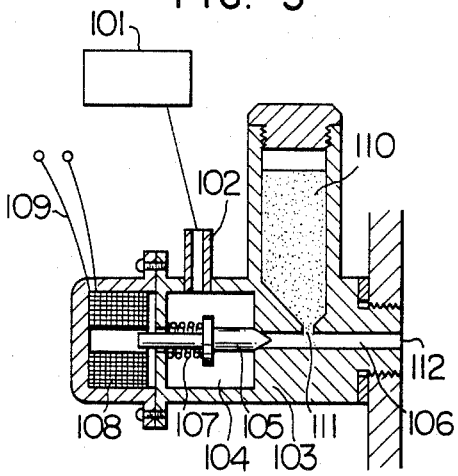
FIG. 3 is a detailed sectional view of a modified particulate supply device.

With reference to FIG. 3, a particle supply device in a modified form is shown. With the arrangement as shown in FIG. 3, the fuel-air mixture got from the suction pipe is compressed by a mixture compression apparatus 101 such as a compressor and is introduced through a mixture inlet port 102 into an accumulator 104 defined in a housing 103 to be accumulated therein. A needle valve 105 provided in the accumulator 104 is biased by a compression spring 107 to normally cut off communication between an injection conduit 106 and the accumulator 104. Electric energization of a solenoid 108 through conductors 109 during a predetermined period of time at an ignition timing moves the needle valve 105 to permit communication between the accumulator 104 and the injection conduit 106, so that a predetermined amount of the compressed fuel-air mixture from the accumulator 104 passes through the injection conduit 106 and is emitted through an injection port 112 into the combustion coamber together with particles which have been supplied through a communication conduit 111 from a storage chamber 110 to be deposited midway of the injection conduit 106.

Figure 4:
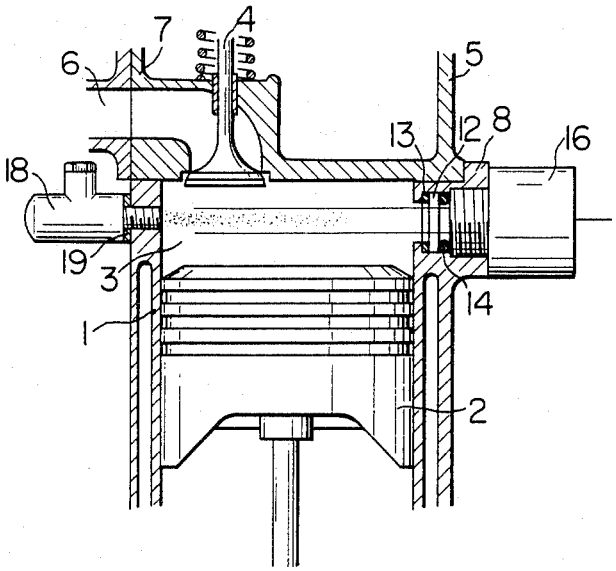
FIG. 4 is a diagrammatic view of another embodiment of the present invention.

While a light beam from the light source 16 as shown in FIG. 1 is condensed, such condensation of the light beam is not needed in case the output of the light source is sufficiently large for ignition of the fuel-air mixture. Thus the condensing lens 11 as shown in FIG. 1 can be omitted as shown in FIG. 4.

Figure 5:
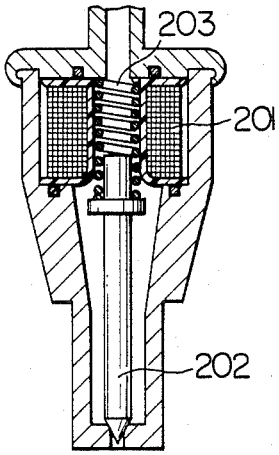
FIG. 5 is a detailed sectional view of a particulate supply device according to a further embodiment of the present invention.

In the embodiment as described above, solid particles are used as light absorption powder. However, atomized liquid particles such as tar, pitch and COM (C heavy oil mixed with powdered coal) may be used as light absorption powder. In this case, it is preferable to replace the particle supply device 18 by an electrical injection valve which comprises a solenoid (electromagnetic coil) 201, a needle valve 202 and a coiled spring 203, as shown in FIG. 5. The electrical injection valve as shown in FIG. 5 is adapted to inject liquid.

As described above, the present invention does not employ any spark plug for generating spark discharge of high tension and therefore is free from drawbacks of spark plugs which include impossibility of ignition of a fuel-air mixture due to difficulty in spark discharge or reduction of discharge energy caused by adhesion of carbon to the surface of an insulator and consumption of electrodes in use. The ignition device according to the present invention has an advantage in that an ignition point can be located at the most favorable position in terms of an air-fuel ratio of a fuel-air mixture in the combustion chamber of an engine and flow of the fuel-air mixture therein.

Furthermore, according to the present invention, a period of time required for absorbing light can be extended by having particles of a high light absorption index absorbing light energy along an optical axis, so that the particles readily serves as an ignition source of high temperature to enable igniting the fuel-air mixture effectively. Therefore, dielectric breakdown of the fuel-air mixture in the field of high light energy of scores of megawatts can be avoided by using a light source of a relatively small output. Accordingly, the ignition device of the present invention is effective for economy of electric power and is small-sized for low cost.

What is claimed is:

1. An ignition device for use with internal combustion engines and adapted for conducting a light beam into a combustion chamber of the engine and igniting a mixture of fuel and air, said device comprising a light emission means opened to the combustion chamber for emitting the light beam and a particle supply means disposed in opposed relation with the light emission means for supplying particles of a high light absorption index separately from said fuel, said particle supply means being adapted to emit the particles along the optical axis of the light beam into the combustion chamber, thereby permitting the particles to be heated at a suitable position within the combustion chamber and the heated particles to serve as an ignition source for igniting the mixture.

2. An ignition device as set forth in claim 1 wherein the light beam is condensed such that the minimum light condensing point is established at a position where the particles exist.

3. An ignition device as set forth in claims 1 or 2 wherein the particles are combustible so as to burn together with the mixture in the combustion chamber.

4. An ignition device as set forth in claim 1 wherein the particles are a solid.

5. An ignition device as set forth in claim 1 wherein the particles are a liquid.

6. An ignition device as set forth in claim 1 wherein said particle supply means comprises a housing, a storage chamber defined by said housing and adapted for storing the particles, an injection conduit opened to the combustion chamber and to which the particles from said storage chamber drop by gravity, and a rod closely slidable in said injection conduit such that the particles deposited in said injection conduit are pushed out into the combustion chamber by the tip end of said rod.

7. An ignition device as set forth in claim 1 wherein said particle supply means comprises a housing, a storage chamber defined by said housing and adapted for storing the particles, an injection conduit opened to the combustion chamber and to which the particles from said storage chamber drop by gravity, an accumulator chamber for accumulating under pressure the fuel-air mixture got from the suction pipe of the engine and a needle valve provided with a solenoid disposed in the accumulator chamber and a coiled spring and adapted for opening to emit the fuel-air mixture into said injection conduit so that the pressure of the fuel-air mixture emits the particles into the combustion chamber.

8. An ignition device as set forth in claim 1 wherein said particle supply means comprises an injection valve including a needle valve adapted for opening due to the action of an electromagnetic coil.

* * * * *